US011535420B2

(12) United States Patent
Prior et al.

(10) Patent No.: US 11,535,420 B2
(45) Date of Patent: Dec. 27, 2022

(54) EXPANDABLE PACKAGING FOR FACILITATING BEVERAGE COOLING

(71) Applicant: Atlantic Packaging Products Ltd., Scarborough (CA)

(72) Inventors: Luis Prior, Whitby (CA); Steve Noorhoff, Scarborough (CA)

( * ) Notice: Subject to any disclaimer, the term of this patent is extended or adjusted under 35 U.S.C. 154(b) by 0 days.

(21) Appl. No.: 16/573,105

(22) Filed: Sep. 17, 2019

(65) Prior Publication Data

US 2020/0180807 A1 Jun. 11, 2020

Related U.S. Application Data

(60) Provisional application No. 62/787,334, filed on Jan. 1, 2019.

(51) Int. Cl.

| | |
|---|---|
| ***B65D 5/24*** | (2006.01) |
| ***B65D 5/56*** | (2006.01) |
| ***B65D 5/46*** | (2006.01) |
| ***B65D 5/20*** | (2006.01) |

(52) U.S. Cl.

CPC ..... *B65D 5/248* (2013.01); *B65D 5/563* (2013.01); *B65D 5/2076* (2013.01); *B65D 5/46088* (2013.01)

(58) Field of Classification Search

CPC ..... B65D 5/248; B65D 5/563; B65D 5/0005; B65D 5/241; B65D 5/244; B65D 5/247; B65D 5/242; B31B 2120/302; A45C 11/20

USPC ..... 229/172, 101, 186, 103, 5.84, 5.81; 206/427; 190/107; 493/185, 311; 220/4.08, 62.1

See application file for complete search history.

(56) References Cited

U.S. PATENT DOCUMENTS

| | | | | |
|---|---|---|---|---|
| 8,191,761 | B2 * | 6/2012 | Brand | B65D 5/46192 229/117.12 |
| 8,596,520 | B2 * | 12/2013 | Scott | B65D 5/24 229/125.19 |
| 9,212,842 | B2 * | 12/2015 | Vasbinder | F25D 3/08 |
| 9,499,294 | B1 * | 11/2016 | Costanzo, Jr. | B65D 5/4608 |
| 9,938,035 | B2 * | 4/2018 | Block | B65D 5/0005 |
| 10,543,951 | B2 * | 1/2020 | Costanzo, Jr. | B31B 50/734 |

* cited by examiner

*Primary Examiner* — Christopher R Demeree
(74) *Attorney, Agent, or Firm* — Bryce D. Miracle, Esq.

(57) ABSTRACT

A case for beverage containers comprising a single continuous waterproof surface having walls and a floor and defining a container space, the container space being expandable by the movement of at least one of the walls so as to expand the container space.

6 Claims, 4 Drawing Sheets

EXPANDABLE PACKAGING FOR FACILITATING BEVERAGE COOLING

CROSS-REFERENCE TO RELATED APPLICATION

This application is based upon and claims the priority filing date of the previously filed, U.S. Provisional patent application entitled "EXPANDABLE PACKAGING FOR FACILITATING BEVERAGE COOLING" filed Jan. 1, 2019, Ser. No. 62/787,334, the entire disclosure of which is hereby incorporated herein by reference. This application is based upon and claims the priority filing date of the previously filed, Canadian patent application entitled "EXPANDABLE PACKAGING FOR FACILITATING BEVERAGE COOLING" filed Sep. 17, 2018, U.S. Pat. No. 3,017,504, the entire disclosure of which is hereby incorporated herein by reference.

FIELD OF THE INVENTION

This invention relates generally to the field product packaging, and more specifically, to the field of packaging of beverages, most typically canned or bottled beverages.

BACKGROUND OF THE INVENTION

It is typical for bottled or canned beverages, such as beer and soda, to be packaged for sale in paper cases. Such paper cases may be composed of corrugated paper, cardboard, or other known appropriate paper products. A case may, for example, hold some number of cans and bottles, such as 12 or 24.

Often, at the time of purchase, the beverages are at room temperature. However, ideally, they should be chilled for consumption, as they are best enjoyed cold. Thus, a purchaser would typically need to remove the beverage containers from the case, and place them in a refrigerator to cool them. Alternatively, the entire case may be placed in a refrigerator, if there is enough room. Either way, it may take an hour or more for the beverages to become adequately chilled. The greater the number of bottles or cans placed in the refrigerator at once, the longer it will take for the bottles and cans to be adequately chilled.

Sometimes, a refrigerator is unavailable. For example, a consumer may buy a case of beer on the way to the beach. Such a consumer would want to chill the beer, but is unlikely to have a refrigerator available. Therefore, he may need to bring along a large cooler, with ice, to chill his beer.

SUMMARY OF THE INVENTION

Thus, according to an aspect of the invention, there is provided a case for beverage containers, the case comprising a single continuous waterproof surface having walls and a floor and defining a container space, the container space being expandable by the movement of at least one of the walls so as to expand the container space. Optionally, the case is composed of paper lined with a waterproof layer to prevent water in the container space from contacting the paper. Optionally, the paper comprises corrugated paper or cardboard. Optionally, the at least one wall is connected to at least another wall by an expandable portion such that when the at least one wall is moved, the expandable portion permits the movement while maintaining the single continuous surface.

BRIEF DESCRIPTION OF THE DRAWINGS

Reference will now be made, by way of example only, to the figures which illustrate the preferred embodiment of the invention, and in which.

DETAILED DESCRIPTION

Figure 1:
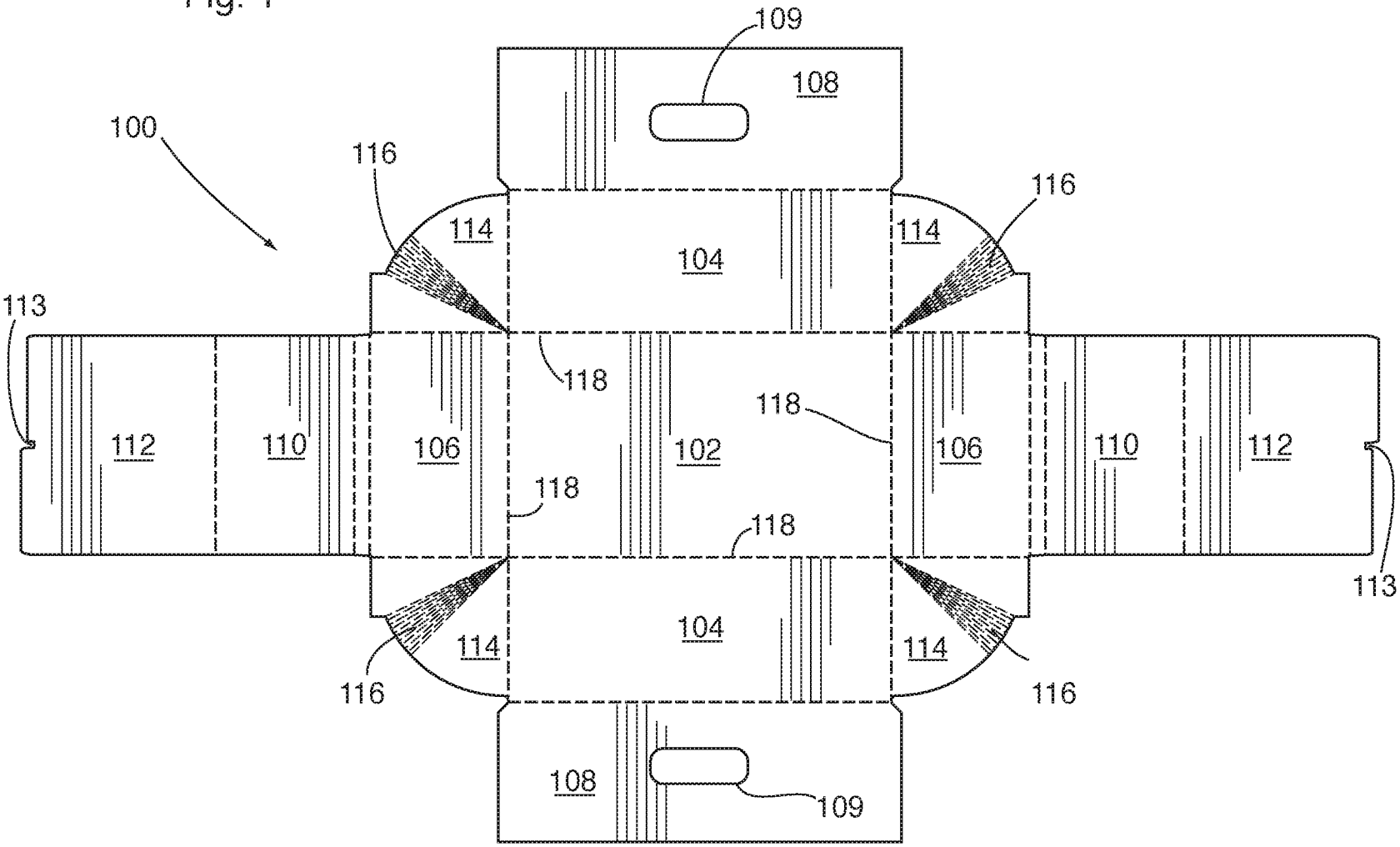
FIG. 1 is a plan view of the outside of the preferred embodiment of the packaging apparatus in its unfolded state.

The present inventors have discovered packaging apparatus and method for conveniently cooling food or drink, most typically beverages purchased in paper cases, such as bottles or canned beer or soda. Most preferably, the beverages would be sold in the packaging apparatus, which apparatus is adaptable to facilitate convenient cooling within the apparatus itself, as described in more detail below.

It is believed that two of the most convenient ways to cool beverages within the packaging apparatus are by means of (a) ice cubes (or crushed ice) or (b) a mixture of ice and water. Referring to option (b), it may also be useful to mix salt into the water together with the ice, to reduce the melting point of the water while allowing it to remain liquid at a temperature at which it would normally freeze.

For either option, it is beneficial for the packaging apparatus to hold water without leaking. Even for option (a), while cooling the beverages, the ice would tend to melt, and the packaging apparatus should preferably be able to hold the melt water without leakage. Thus, for most cooling agents typically conveniently available to a consumer, the ability of the packaging apparatus to hold water without leaking would be beneficial.

One way to provide the water tightness referred to above is to use a coated paper product for the case, whose coating acts as a barrier to the leakage of water. It will be appreciated that ordinary cardboard or corrugated paper will be quickly and significantly weakened by water pooling within a cardboard or corrugated paper case. However, it is believed that coated papers, such as Barrier Board™ manufactured by Atlantic Coated Papers of Whitby, Ontario, Canada, can be effectively used to make paper cases that can hold water without significant weakening or leaking within the relevant time frame for beverage cooling. The aforementioned coated paper comprises at least one thin moisture barrier layer sandwiched between two paper layers. This is in turn laminated on to the cardboard or corrugated board case. Thus, the case provides the usual strength and stability of cardboard or corrugated board cases, while also providing the paper of the case with moisture protection to prevent the paper from being weakened or destroyed by water. It will be appreciated that other coated papers, or components or configurations to provide water tightness could be employed and still be comprehended by the invention.

Another beneficial feature of the preferred packaging apparatus is that it is expandable to provide additional space for the cooling agent. When cans or bottles are sold in cases, they are generally tightly packed. If ice, or ice water, is simply poured into the packaging apparatus, then much of the cooling agent will just sit on top of the cans or bottles. There will be relatively little cooling agent in contact with most of the surface area of the cans or bottles. In addition, the tightly packed cans and bottles will act as one large single thermal body that would take a long time to cool. By expanding the packaging apparatus, the cans or bottles can be spread out, so that when the cooling agent is placed into the packaging apparatus, substantial amounts of cooling agent act on a larger percentage of the surface area of the bottles and cans. This in turn would have the effect of speeding up the rate at which heat is transferred out of the cans and bottles and into the cooling agent, and thus, the rate at which the beverages are cooled.

Referring now to FIG. 1, a drawing of the preferred embodiment of the packaging apparatus in its unfolded state is shown with a view of the outside of the case. As will be described below in greater detail, the preferred embodiment is a single piece, initially flat and unfolded, that is folded into a container for holding food or drink, most typically beverage cans or bottles. The preferred embodiment is designed so that, when folded into its final shape, there is a single continuous surface that makes up both the walls of the container and the floor of the container. Thus, there is no crack, slot, gap or other space through which water could leak. It will be appreciated that, without the need to protect against water leakage, it would be sufficient for a case to simply have no spaces through which a bottle or can could escape. However, water-tightness requires that there be no gaps in the walls or floor of the case, and no gaps between any of the walls, and no gap between the floor and any of the walls. Even having two separate pieces of the case pushed firmly up against one another does not generally provide adequate leak protection, as water could escape between those two pieces even in the absence of any visible gap. Thus, the preferred packaging apparatus comprises one continuous surface that makes up both the walls and the floor of the case.

The preferred embodiment of the packaging apparatus comprises a corrugated paper case, lined with a water- and leak-resistant layer as mentioned above. The layer should preferably be positioned on the inside of the case to prevent water from reaching the corrugated paper that the case is composed of.

The scores in the corrugated paper, used to create fold creases for assembling the case 100, are shown in FIG. 1 as stippled lines. Floor 102 is connected to sidewalls 104 and end walls 106 at creases 118. Positioned between each end wall 106 and each side wall 104 is a generally quarter-circular connecting portion 114. It will be appreciated that the four portions 114, the sidewalls 104, the end walls 106 and the floor 102 are all formed as a single continuous surface with no gaps that would allow water to escape sideways or vertically downward once the case 100 is formed into the shape of a container.

Each portion 114 includes a flexible area 116. The flexible area 116 is configured to permit the portion 114 to be easily moved in a folded-over state, as will be described further below. The movement involves the fold in portion 114 changing its position to allow the case 100 to be expanded. Thus, in the preferred embodiment, the flexible area 116 is crushed or otherwise made more flexible in a foldable manner to allow an easily-moving fold along area 116.

Attached to end walls 106 are inner walls 110 and locking portions 112. When the case is assembled, inner walls 110 are positioned inside of and parallel to end walls 106 within the case and locking portions 112 are positioned above and parallel to floor 102. The locking portions 112 include lock elements 113 which engage with one another to hold the case in the assembled position. Also, in the preferred embodiment, flaps 108, which include handles 109 are attached to sidewalls 104. When the beverages are being sold in case 100, the flaps 108 are folded over toward one another and glued to provide a sealed case. The case is opened by detaching the glued the flaps 108 and folding them outward to gain access to the interior of the case.

Figure 2:
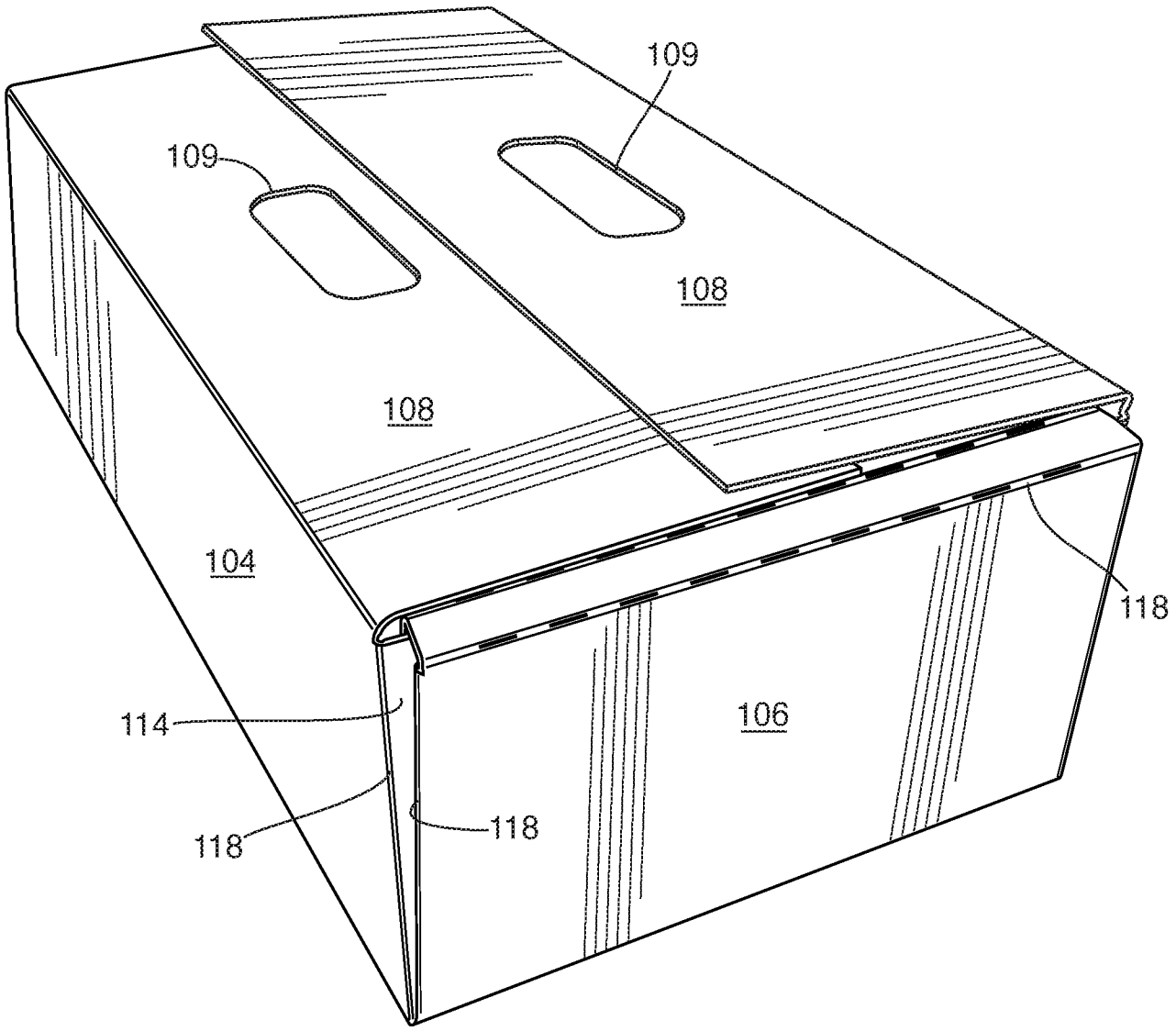
FIG. 2 is a perspective view of an embodiment of the packaging apparatus in a folded and closed state.
Figure 3:
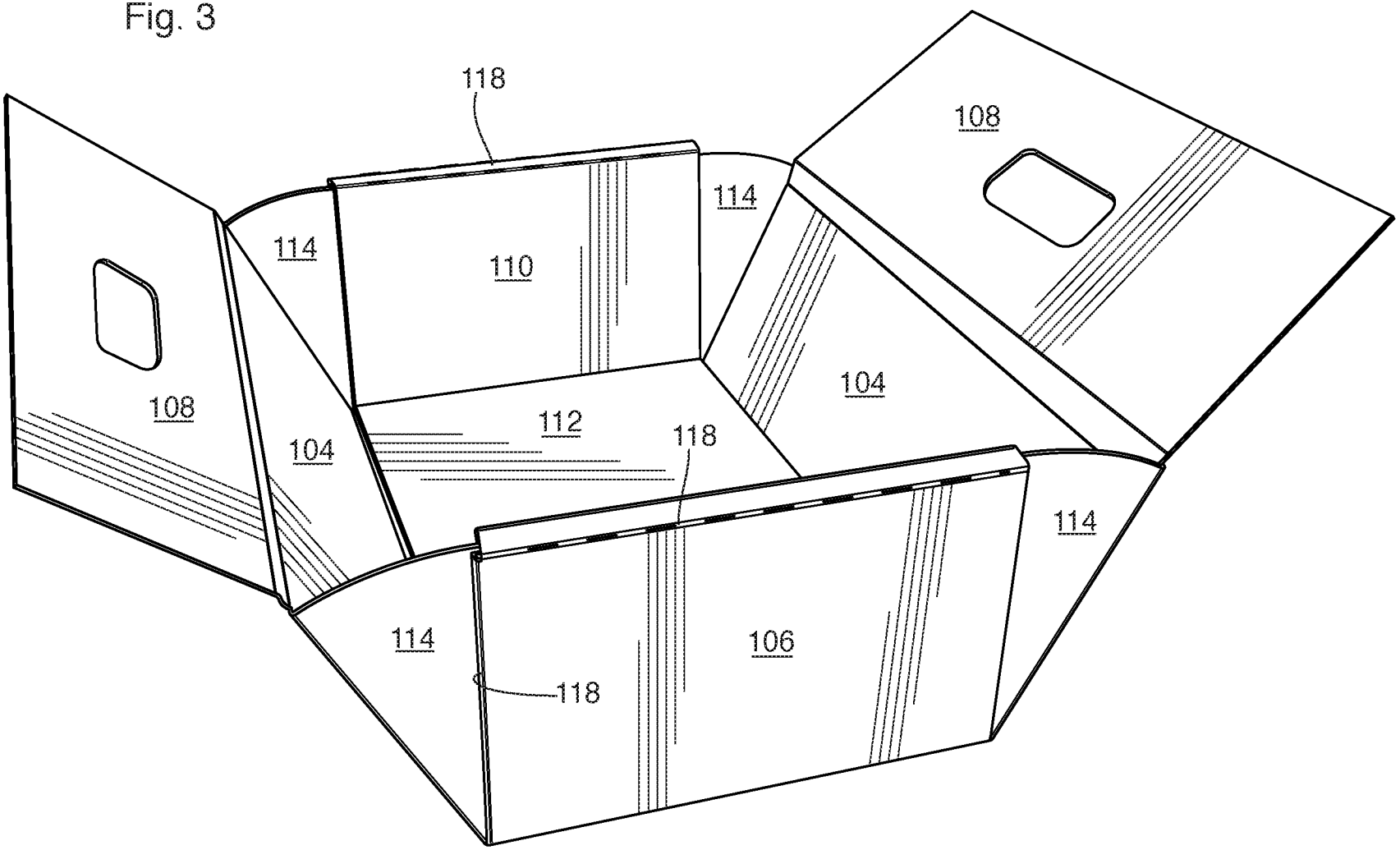
FIG. 3 is a perspective view of an embodiment of the packaging apparatus in an open and expanded state.

Referring now to FIG. 2, the case 100 is shown in an assembled and closed state, the state in which the case would typically be when the beverage cans/bottles are being sold to consumers. FIG. 3 shows case 100 in an assembled, opened and expanded state. It will be appreciated that, in the expanded state, extra space is created between sidewalls 104 and the beverage bottles or cans (not shown). This space can be used to spread out the beverage containers and pour ice, or ice water, or some other cooling agent, into case 100 to facilitate faster cooling of the beverage bottles or cans.

Figure 5:
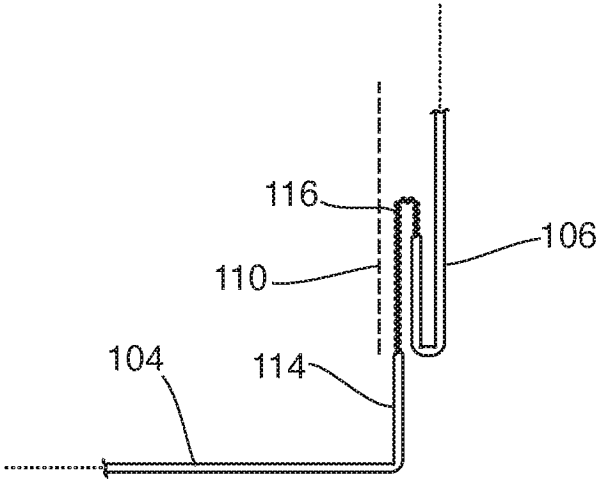
FIG. 5 is a top cut away view of a portion of an embodiment of the packaging apparatus in an expanded state.
Figure 4:
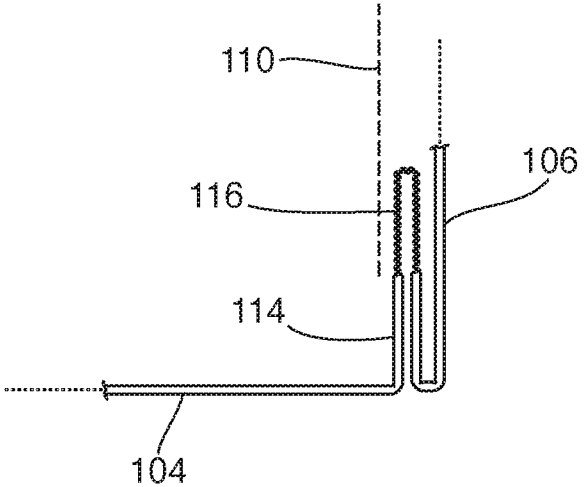
FIG. 4 is a top cut away view of a portion of an embodiment of the packaging apparatus in an unexpanded state.

As can be seen in FIG. 3, and also in FIGS. 4 and 5, portions 114 are extended outward from end walls 106 when case 100 is in its expanded state (in the preferred embodiment, when sidewalls 104 are pulled out). As the edges of portions 114 are connected to sidewalls 104 and end walls 106, when sidewalls 104 are expanded, portions 114 are pulled outward. The point at which portion 114 is folded (which is located on area 116) shifts or rolls to permit the extension of portion 114. This shifting of the folding point is facilitated by flexible area 116, which, due to its flexibility, facilitates a rolling folding point, which in turn permits the expansion of sidewalls 104.

FIG. 4 shows a top cut away view of end wall 106, portion 114 and sidewall 104 when the sidewall 104 is not in an expanded position. FIG. 5 shows the same elements and view, when sidewall 104 is in an expanded position. Inner wall 110 is shown in stippled lines in FIGS. 4 and 5. Portions 114 with areas 116 are folded between inner wall 110 and end wall 106, and provide the slack that connects sidewalls 104 to the case 100 to permit the sidewalls 104 to be extended to expand case 100. When the sidewalls 104 are extended, some or all of the slack is taken up. Because portions 114 are folded with the fold positioned on corresponding area 116, when sidewalls 104 are expanded, and portion 114 pulled outward, the fold moves within area 116 to allow portion 114 to be pulled outward. It is for this reason that area 116 is preferably crushed (by a non-puncturing and non-damaging means) to give area 116 increased flexibility, so that the fold can roll smoothly along area 116 as the portion 114 is pulled outward or pushed inward. This rolling of the fold along area 116 is shown in FIGS. 4 and 5. In FIG. 5, the fold has moved toward the end of portion 114 attached to the end wall 106, as portion 114 has been pulled outward.

It will be appreciated that the preferred embodiment of case 100 can take a variety of forms within the scope of the invention. Area 116 may be an accordion-style area to permit flexibility and to facilitate the rolling of the folding point of portion 114. As another example, there may be more or fewer than four portions 114, depending on the shape of case 100, and the amount of space expansion desired for case 100.

The invention claimed is:

1. A case for beverage containers, the case comprising a single continuous waterproof surface defining a container space comprising a floor and at least a first wall and a second wall, the first wall being movably coupled to the second wall so as to expand the container space by movement of the first wall, the container further comprising a connecting portion coupling the first wall to the second wall, the connecting portion having a fold therein that moves along the connecting portion as the first wall is moved so as to expand the container space while maintaining the single continuous waterproof surface, wherein the fold moves along the connecting portion by a rolling movement.

2. The case of claim 1, wherein the connecting portion comprises a flexible area, the flexible area comprising a flexible material to facilitate the rolling movement of the fold.

3. The case of claim 2, wherein the flexible material is crushed corrugated paper or crushed cardboard.

4. The case of claim 1, wherein the connecting portion comprises a flexible area and a remaining portion, wherein the fold moves within the flexible area but not the remaining portion.

5. The case of claim 4, wherein the flexible area is made of crushed corrugated paper or crushed cardboard.

6. The case of claim 1, wherein the connecting portion comprises a flexible area and a remaining portion, wherein the fold is positioned on the flexible area, the flexible area but not the remaining portion comprising of crushed corrugated paper or crushed cardboard to facilitate the rolling movement of the fold.

* * * * *